US005251264A

United States Patent [19]

Tichy

[11] Patent Number: 5,251,264

[45] Date of Patent: Oct. 5, 1993

[54] MECHANICAL-VIBRATION-CANCELLING PIEZO CERAMIC MICROPHONE

[75] Inventor: Thomas H. Tichy, Albuquerque, N. Mex.

[73] Assignee: Motorola, Inc., Schaumburg, Ill.

[21] Appl. No.: 857,210

[22] Filed: Mar. 25, 1992

[51] Int. Cl.[5] ..... H04R 25/00; H04R 3/00

[52] U.S. Cl. ..... 381/173; 381/114; 381/122

[58] Field of Search ..... 381/173, 168, 170, 174, 381/176, 92, 190, 191, 122, 113, 114

[56] References Cited

U.S. PATENT DOCUMENTS 4,156,800 5/1979 Sear et al. ..... 381/173
4,329,547 5/1982 Imai ..... 381/174
4,491,697 1/1985 Tanaka et al. ..... 381/174

FOREIGN PATENT DOCUMENTS 0234000 9/1989 Japan ..... 381/174

*Primary Examiner*—Jin F. Ng
*Assistant Examiner*—Sinh Tran
*Attorney, Agent, or Firm*—Joseph P. Krause

[57] ABSTRACT

In applications where mechanical vibrations should not cause a microphone to produce an output signal, opposing and series connected PZT elements (A and B) are used to cancel mechanical shock or vibration that might cause an output voltage or signal. Acoustic waves cause the PZT elements to deflect in opposite directions which when the sensors (A and B) are electrically in series produce a measurable output.

8 Claims, 3 Drawing Sheets

MECHANICAL-VIBRATION-CANCELLING PIEZO CERAMIC MICROPHONE

FIELD OF THE INVENTION

This invention relates to microphones. More particularly this invention relates to microphones using lead-zirconate-titanate (PZT) pressure sensing elements.

BACKGROUND OF THE INVENTION

Microphones that use PZT are well known in the prior art. These microphones typically use so-called bimorphic PZT (A bimorph uses two PZT layers separated by an intermediate conductive layer.) devices that generate small electrical voltages in response to mechanical displacements caused by air pressure changes.

A problem with piezo ceramic microphones however, as well as virtually all other types of microphones, is their susceptibility to mechanical vibrations, which vibrations can themselves cause the ceramic elements in a piezo ceramic microphone to vibrate and thereby produce spurious output voltages. In applications where a microphone is susceptible to mechanical shock, such mechanical shocks can distort or mask particular audio signals of interest.

One potential application for a microphone that must be resistant to mechanical shocks might include for example an active noise cancellation system for an automobile exhaust system. In such a system the sound waves emitted in the exhaust system of an automobile might be effectively cancelled or significantly reduced if the sound waves emitted from the exhaust system are precisely measured and a cancellation wave is produced at a precise instant, which cancellation wave might effectively cancel a sound wave emitted from the automobile exhaust system.

In such an active noise cancellation system, most prior art microphones would likely be unusable because of their susceptibility to electromagnetic interference, vibration, moisture, corrosive exhaust gases, dirt, and heat. A microphone that is more well able to withstand such an environment would be an improvement over the prior art.

SUMMARY OF THE INVENTION

There is provided a mechanical-vibration-cancelling microphone comprised of a housing that encloses a volume, access to which is through an opening through which acoustic waves can pass. First and second piezo ceramic pressure sensing elements, are mounted within the housing such that acoustic waves that pass into the enclosed volume cause both the first and second pressure sensing devices to deflect in opposite directions with respect to each other. (The invention disclosed herein could use either monomorph or bimorph elements. A monomorphic PZT element is comprised of a single layer of PZT between two very thin electrodes. A relatively rigid backing plate is coupled to the electrode and PZT element on one side.) The piezo sensing elements are wired electrically in series such that when these elements deflect in opposite directions in response to an acoustic wave, the voltage across their series connection is additive. If the piezo sensing elements deflect in a common direction, which would be caused by a mechanical shock or vibration to the housing, the voltages produced by the two elements cancel each other producing no output voltage in response to their mechanical displacement.

DESCRIPTION OF A PREFERRED EMBODIMENT

Figure 1:
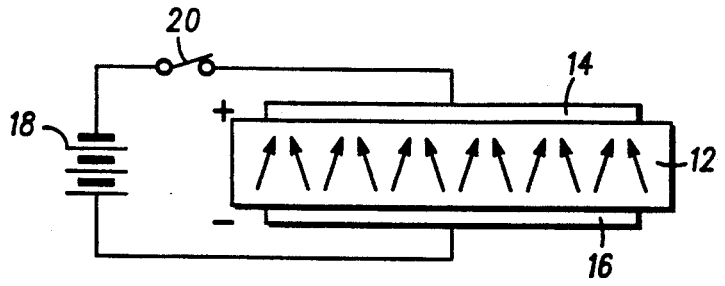
FIG. 1 shows a schematic diagram of a simplified circuit used to polarize a PZT element after its manufacture.

FIG. 1 shows a schematic diagram of a simplified prior art circuit used to polarize a lead-zirconate-titanate (PZT) ceramic element (12). The PZT element (12), which in the instant application is preferably a very thin disc shaped element (also shown in FIG. 8), has deposited on its upper and low planar surfaces, first and second electrodes (14 and 16). The electrodes are comprised of a thin layer of nickel, typically around 2000 angstroms thick.

After the PZT element (12), which is a ceramic, is initially manufactured, it is normally unpolarized and not piezoelectric per se, but upon closure of the switch (20) and the subsequent application of the electric field provided by the voltage from the power or battery source (18), the structure of the crystalline PZT material is altered element thereafter is considered to be electrically polarized and thereafter behaves as a piezoelectric material. The PZT element (12) is polarized by the application of an appropriate electrical field, which field might be supplied, for example, by a battery (18) as shown in FIG. 1. If the magnitude of the electric field supplied by the battery (18) is sufficiently great, the crystalline structure of the PZT element (12) will thereafter be polarized.

Figure 2:
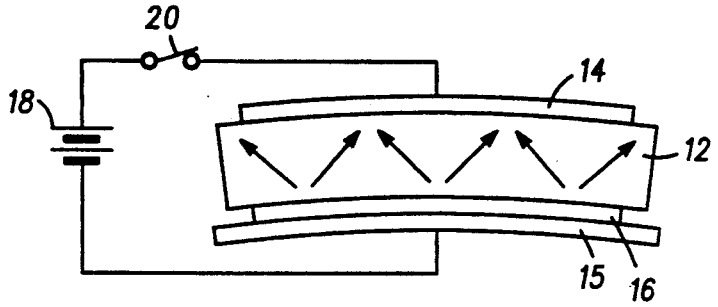
FIG. 2 shows a schematic representation of the deformation of a PZT element caused by application of a voltage after the PZT elements polarization.

FIG. 2 shows a schematic representation of the effects of application of an opposing electric field to the PZT element (12) after its polarization. In FIG. 2, an electric field is supplied by the battery (18) to the PZT element albeit in FIG. 2, a relatively rigid backing plate to which the PZT is bonded stays fixed while PZT away from the backing plate is permitted to expand and contract upon the application of an electric field. When the switch (20) is closed, the electric field applied by the battery (18) opposes the orientation of the polarization of the PZT element (12) that was established by the polarity of the battery (18) shown in FIG. 1. When an electric field is applied to the PZT element (12) through the electrodes (14 and 16), the orientation of which opposes the orientation of the grains of the PZT element, the upper surface of the PZT element will spread or elongate slightly while PZT attached to the backing plate is stationary. While the depiction of the deflection shown in FIG. 2 is an exaggeration and is certainly not to scale, FIG. 2 does depict how a PZT element (12) actually deforms in response to an opposing electric field.

Figure 3:
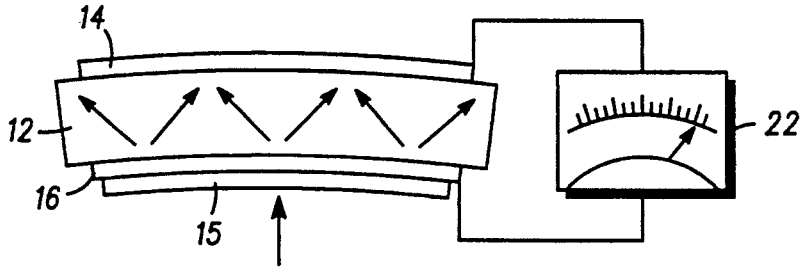
FIG. 3 shows a simplified schematic representation of a PZT element producing an output voltage across its surfaces caused by a mechanical displacement of the element.

While it is true that a PZT element will deform in response to an applied electric field, it is also true that a polarized PZT element (12) such as that shown in FIG. 1, will produce a small voltage across electrodes (14 and 16) if the PZT element coupled to a backing plate (15) is mechanically deformed by, for example, a mechanical or physical force (F) acting in such a direction so as to deflect the PZT element (12). In FIG. 3, the PZT element (12) shows a small voltage being generated across its electrodes (14 and 16) as measured by a voltmeter (22). By virtue of the mechanical disruption of the grains of the material in response to the applied force (F). It is this small voltage that is produced by a deformed PZT element that permits its use as an element in a microphone.

Figure 4:
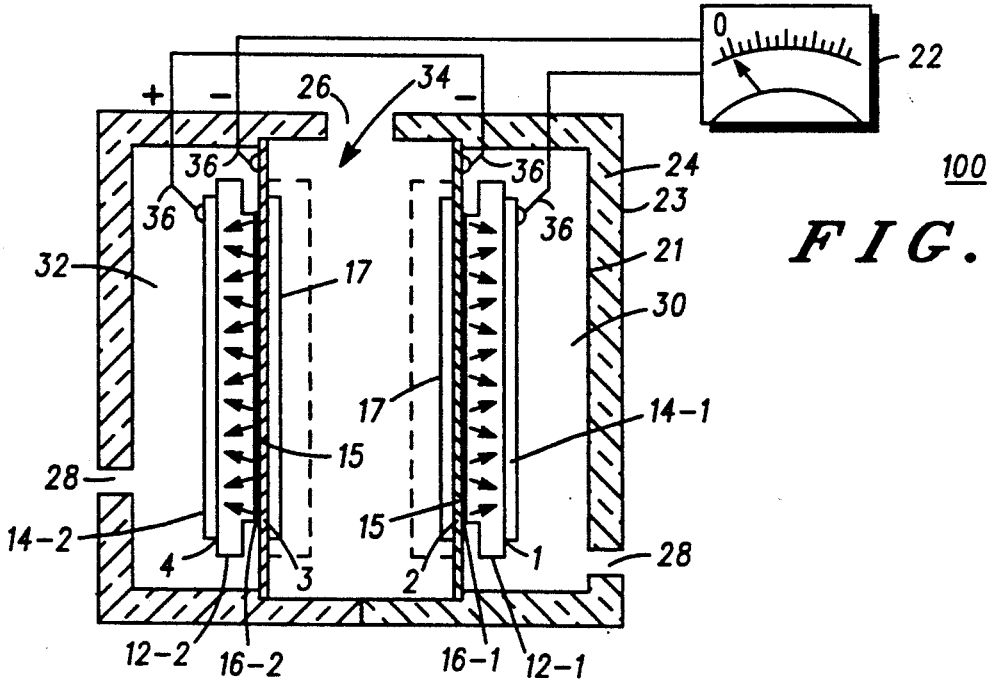
FIG. 4 shows a cross sectional view of a mechanical vibration cancelling microphone in its quiescent state.

FIG. 4 depicts a cross sectional view of a mechanical-vibration-cancelling microphone (100). The microphone is comprised of a housing (24) having an interior (21) and an exterior (23) surface that substantially encloses a volume (comprised of the separate volumes 30, 32, and 34) within the interior surface (21) of the housing (24). The housing which is molded plastic, is comprised of two halves, which can be glued together after the PZT pressure sensing elements are installed in each. An opening in the housing (26) permits acoustic waves to pass into the enclosed volume (30, 32, and 34).

A first PZT pressure sensor (A) is comprised of a first PZT element (12-2) and first and second electrodes (14-2 and 16-2) coupled to the respective planar sides or surfaces of the PZT element (12-2). A relatively rigid backing plate (15), to which the PZT element (12-2) is coupled and which also acts as a conductive diaphragm, permits the PZT element to produce an output voltage when the PZT is bent because the PZT material furthest from the backing plate is expanding (or contracting) while the PZT closest and coupled to the backing plate (15) is fixed. A second PZT pressure sensing element (B) is comprised of a PZT element (12-1) and its own respective electrodes (16-1 and 14-1) coupled to another backing plate (15). Both these first and second PZT pressure sensing elements, which are preferably a matched pair of elements, are capable of generating nearly identical voltages across or between their respective first and second sides (which sides have the electrodes coupled to them) when they are laterally displaced in either direction.

Each of the first and second PZT pressure sensing elements (A and B) are fixed within the housing at their respective first and second locations, substantially as depicted in FIG. 4. The first PZT element A is fixedly mounted in the housing (24) to enclose a first sealed volume (32) between the first PZT element's first side in the interior surface (21) of the housing (24).

The second PZT element (B) encloses a second sealed volume (30) between its second side and the housings' interior surface (21) as shown. The placement of the first PZT pressure sensor (A) and the second PZT pressure sensor (B), which enclose the first and second sealed volumes (32 and 30) respectively, define a third, unsealed, volume (34) which is accessible through the openings (26) and the housing (24). The opening (26) permits acoustic waves external to the housing to enter this unsealed volume (34) through the opening (26).

In the preferred embodiment, small gauge wires (36) (approximately 38 gauge) are used to provide a low-stiffness, low-mass connection to the PZT element. These small gauge wires are connected to either a terminal on the housings side or to a larger gauge wire that passes through the side of the housing and thereby provide a means for coupling the first and second pressure sensors (A and B) electrically in series such that upon a deflection of the sensors (A and B) in opposite directions in response to an acoustic wave in the unsealed volume (34), a voltage is produced between the first side (1) of the first PZT sensor (A) and the second side (4) of the second PZT sensor (B) when the diaphragms comprising said sensors deflect in opposite directions.

Figure 5:
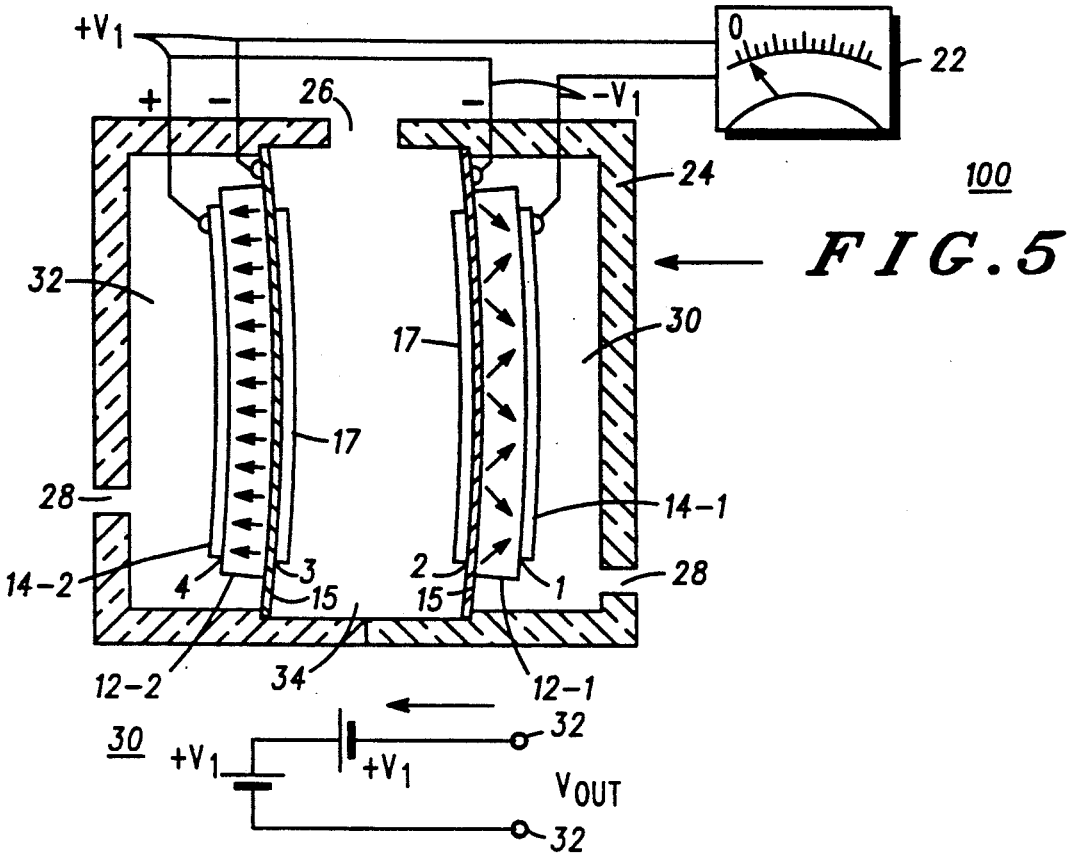
FIG. 5 shows the microphone of FIG. 4 subjected to a lateral mechanical force.

Turning to FIG. 5, there is depicted the vibration cancelling microphone (100) of FIG. 4 but showing the deflection of the first and second PZT pressure sensors as they are deflected in response to the application of a lateral force (F) as shown. When both PZT's sensing elements (A and B) deflect in the same direction, such as might be caused when the housing (24) is vibrated or shocked, the first PZT sensor (A) develops a voltage equal to negative $V_1$ across its first and second surfaces (1 and 2) as shown. A second PZT sensor (B) develops a similar voltage but of opposite polarity with respect to its first and second surfaces (4 and 3) as shown. Since the magnitudes of the voltage is developed across each sensor (A and B) respectively, will be of substantially equal magnitude but opposite polarity, the net voltage measured by a voltmeter (22) across the first surface (1) of the first sensor (A) and the second surface (3) of the second element (B) will be substantially equal to zero. The equivalent circuit diagram (30) shown in FIG. 5 depicts the connections of the series connected sensor elements (A and B) where each sensor element is shown producing a voltage equal to $+V_1$. The output voltage (32) in this case will be equal to zero.

Figure 6:
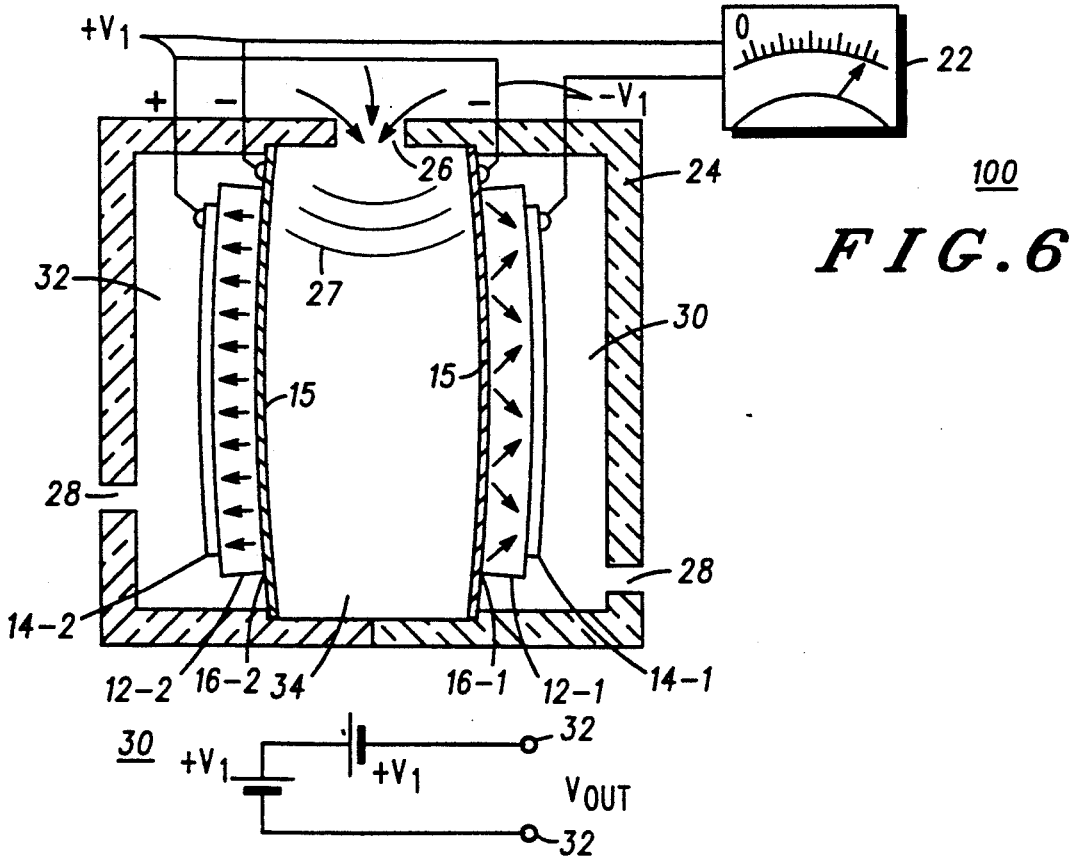
FIG. 6 shows the microphone depicted in FIG. 4 subjected to an acoustic wave.

FIG. 6 shows the vibrating cancelling microphone and the deflection of the first and second pressure sensing elements (A and B) in response to an acoustic wavefront (27) that enters the open volume (34) through the orifice (26). In this case, the pressure sensing elements (A and B), which are still wired electrically in series each produce a voltage of a magnitude $+V_1$, but in this case since the voltages produced by each pressure sensing element is added to the other, a net output voltage (32) is detected by a sensing device such as the meter (22).

Figure 7:
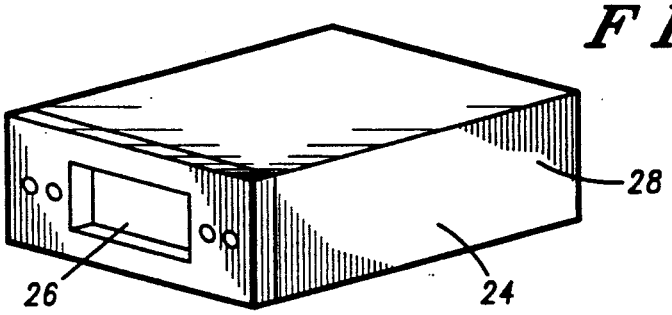
FIG. 7 shows a perspective view of a typical housing that might be used to enclose the PZT elements.

FIG. 7 shows a perspective view of a housing (24) that might be used to enclose the piezo pressure sensor elements shown in the preceding figures. In this figure, as well as in FIG. 4, 5 and 6, a barometric relief (28) which is a hole in the housing relieves pressure buildup in the enclosed volumes (30 and 32) to prevent the diaphragm from being bent, detached, or collapsed by atmospheric pressure changes. Since this invention is intended to be used in widely varying and harsh environments, the diaphragm (15) which is rigidly fixed to the wall of the housing is protected from damage that might be caused by barometric pressure changes, i.e. atmospheric pressure changes external to the sealed volumes (30 and 32). Barometric pressure reliefs ordinarily degrade dynamic response. This invention however uses a unique barometric relief that minimizes the reduction in dynamic response while protecting the diaphragm from potentially damaging barometric pressure changes.

Figure 9:
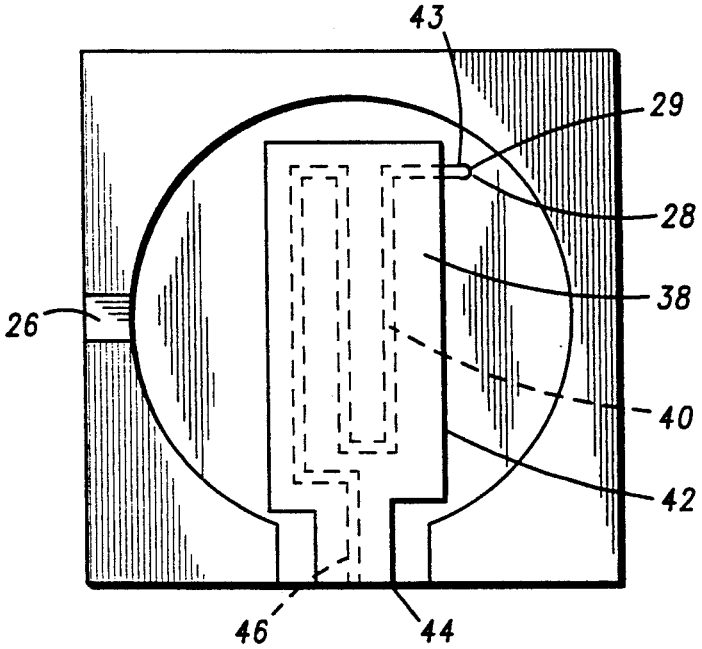
FIG. 9 shows a plan view of the inside of one half of the housing and the structure of the barometric pressure relief.

Referring to FIG. 9, a plan view of the inside of one side of the housing is shown. (In FIG. 9 the pressure sensing element is removed to show a plan view of the inside of the housing and the structure of the barometric pressure relief (28).) The barometric pressure relief (28) is comprised of a long, narrow passage way (38) comprised of a tape-covered slot (40) which is formed in the housing during its manufacture (24). (The housing is preferably molded plastic.) Reference number 42 depicts a piece of tape that is placed over the slot (40), substantially but not completely covering it. At one end (43) of the slot (40), the tape (42) does not completely cover the slot leaving an opening or hole (29) through which air from the sealed volume (30 or 32) can pass into the slot. At the other end (44) of the slot (40) the slot terminates in an opening to the exterior of the housing, at barometric pressure.

Figure 10:
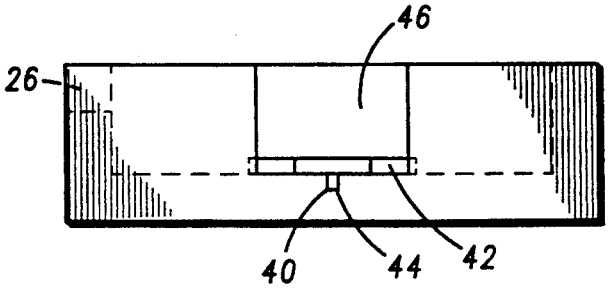
FIG. 10 shows a side view of the half of the housing shown in FIG. 9.

It can be seen in FIG. 10, which depicts a side view of the half of the housing shown in FIG. 9, that there is a slot (46) substantially through the housing at the second end (44) of the slot (40), at the bottom of which is the slot (40) shown in FIG. 9. The housing (24 in FIG. 4) is comprised of identical halves, one of which is depicted in FIG. 9. When the two halves are joined together, to form the housing (24), the large slot (46) is filled with a sealant to insure that barometric pressure changes within the sealed volumes (30 and 32) occur only by air passing through the slot (40), which comprise the barometric pressure relief (28) shown in FIGS. 4, 5, and 6.

It should be noted that if the slot (40) is not sufficiently long, air pressure changes on the exterior of the housing that enter the open volume (34) through the opening 26 will also enter the closed volumes (30 and 32) reducing the frequency response of the device. If the slot is too long, rapid barometric pressure changes might damage the diaphragm.

Figure 8:
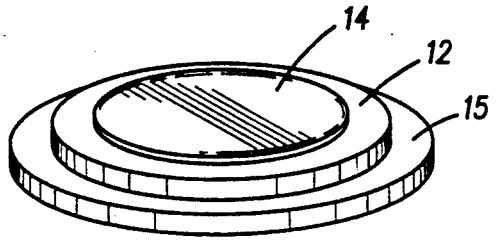
FIG. 8 shows a perspective view of a disc shaped piezo element and its accompanying electrodes.

FIG. 8 shows a perspective view of a PZT monomorph pressure sensing element. The actual PZT layer (12) is coupled to first and second electrodes, however, in FIG. 8 only the top electrode (14) is shown. The backing plate (15) and the PZT element (12) sandwich another electrode not shown in FIG. 8. A bimorph PZT element would include a second PZT element below the lower electrode (16) and would also include another electrode coupled to the opposite side. The physical structure of bimorph PZT elements is well known in the art and is not particularly relevant to the instant invention. Although bimorphs have a more linear output characteristic, they are more costly to produce and because of the additional layer they might be more rigid and hence less sensitive to low intensity sound waves. Those skilled in the art will recognize that a bimorph could be substituted for a monomorph in the foregoing described invention. The broken lines depicted in FIG. 4 on the first and second pressure sensing elements (A and B) depict the location of a second PZT element that would be necessary to comprise a bimorph PZT pressure sensor. (If a bimorph were used, the damping pad (17) would have to be deleted.) In the instant invention, however using a bimorph in an automotive exhaust noise cancellation might require exposing a PZT element and its extremely thin nickel electrode to exhaust gases that would likely destroy the nickel electrode. In most other applications for the invention disclosed herein, the symmetrical bending of a bimorph pressure sensing element and its more linear output voltage might not out weigh the additional cost they require. Those skilled in the art will recognize that depending upon the application of the vibration cancelling microphone, a bimorph PZT element may, however, be required.

In the preferred embodiment, shown in FIG. 4, 5, and 6, the piezoelectric elements (12-1 and 12-2) were comprised of single, round, 0.0028" thick piezo ceramic discs concentrically bonded to self supporting metal backing plates (15). Alternate embodiments would contemplate using square or rectangular elements. The electrodes (16-1 and 16-2) were 2000 angstrom thick layers of nickel on the surfaces of the PZT. A lightweight damping pad (17) (shown only in FIGS. 4 and 5) was used to control the resonance peak and was comprised of a 0.002" thick acrylic adhesive pad sandwiched between the back plate (16-1 and 16-2) and a 0.001" thick aluminum disc coupled to the metal backing plate/diaphragm (15).

The two transducers (A and B) were mounted face to face by gluing them to an edge formed in the housing. The transducers were wired in series so that acoustically electrical signals add and mechanically the electrical signals subtract. The small-gauge wires (36) referred to above were comprised of 38 gauge copper wire.

The microphone disclosed herein provides a method and structure for cancelling out mechanical vibrations from its output signal (as measured by a meter (22) for instance)) and producing an output voltage in response only to the acoustic waves (27) input to the microphone from a source of such energy. Using a more substantial diaphragm, such as the backing plate (15) the microphone becomes much less susceptible to dirt and corrosive exhaust gases.

What is claimed is:

1. A mechanical-vibration-cancelling microphone comprised of:

a housing having interior and exterior surfaces, substantially enclosing a first volume (a first enclosed volume) within said interior surfaces and having at least one opening through said interior and exterior surfaces through which acoustic waves can pass into said enclosed volume;

a first PZT pressure sensor having first and second substantially planar sides, said first PZT sensor being capable of generating a voltage between said first and second sides upon its lateral deformation and fixed within said housing at a first predetermined location;

a second PZT pressure sensor having first and second substantially planar sides, said second PZT sensor being capable of generating a voltage between said first and second sides upon its lateral deformation and being fixed within said housing at a second predetermined location;

said first and second PZT pressure sensors being fixed within said housing such that said first PZT pressure sensor encloses a first unsealed volume between its first side and said housing interior surface and said second PZT pressure sensor encloses a second unsealed volume between its second side and said housing interior surface and where said first and second PZT pressure sensors enclose a third, unsealed volume substantially between said second side of said first PZT pressure sensor and said first side of said second PZT pressure sensor, said third unsealed volume being acoustically coupled to acoustic waves external to said housing by said opening.

2. The apparatus of claim 1 where said first PZT pressure sensor is comprised of a single, substantially planar layer of PZT element having first and second sides, said first side being coupled to a first conductive diaphragm.

3. The apparatus of claim 1 where said second PZT pressure sensor is comprised of a single, substantially planar layer of PZT element having first and second sides, said first side being coupled to a second conductive diaphragm.

4. The apparatus of claim 1 including means for coupling said first and second pressure sensors electrically in series such that upon deflection of said sensors in opposite directions, a voltage is produced between said first side of said first PZT pressure sensor and said second side of said second PZT pressure sensor and that deflection of said diaphragms in like directions produces substantially no voltage between said first side of said first PZT pressure sensor and said second side of said second PZT pressure sensor.

5. A mechanical-vibration-cancelling microphone comprised of:

a housing having interior and exterior surfaces, substantially enclosing a first volume (a first enclosed volume) within said interior surfaces and having at least one opening through said interior and exterior surfaces through which acoustic waves can pass into said enclosed volume;

a first PZT bimorphic pressure sensor having first and second substantially planar sides, said first PZT sensor being capable of generating a voltage between said first and second sides upon its lateral deformation and fixed within said housing at a first predetermined location;

a second PZT bimorphic pressure sensor having first and second substantially planar sides, said second PZT sensor being capable of generating a voltage between said first and second sides upon its lateral deformation and being fixed within said housing at a second predetermined location:

said first and second PZT bimorphic pressure sensors being fixed within said housing such that said first PZT bimorphic pressure sensor encloses a first unsealed volume between its first side and said housing interior surface and said second PZT bimorphic pressure sensor encloses a second unsealed volume between its second side and said housing interior surface and where said first and second PZT bimorphic pressure sensors enclose a third, unsealed volume substantially between said second side of said first PZT bimorphic pressure sensor and said first side of said second PZT bimorphic pressure sensor, said third unsealed volume being acoustically coupled to acoustic waves external to said housing by said opening.

6. The apparatus of claim 5 where said first PZT bimorphic pressure sensor is comprised of a single, substantially planar layer of PZT element having first and second sides, said first side being coupled to a first conductive diaphragm.

7. The apparatus of claim 5 where said second PZT bimorphic pressure sensor is comprised of a single, substantially planar layer of PZT element having first and second sides, said first side being coupled to a second conductive diaphragm.

8. The apparatus of claim 5 including means for coupling said first and second pressure sensors electrically in series such that upon deflection of said diaphragms in opposite directions, a voltage is produced between said first side of said PZT pressure sensor and said second side of said second PZT pressure sensor and that deflection of said diaphragms in like directions produces substantially no voltage between said first side of said PZT pressure sensor and said second side of said second PZT pressure sensor.

* * * * *